US005373109A

United States Patent [19]

Argyrakis et al.

[11] Patent Number: 5,373,109

[45] Date of Patent: Dec. 13, 1994

[54] ELECTRICAL CABLE HAVING FLAT, FLEXIBLE, MULTIPLE CONDUCTOR SECTIONS

[75] Inventors: Straty N. Argyrakis, Highland; Richard W. Oldrey, Clintondale, both of N.Y.; Eugene E. Steele, San Jose, Calif.

[73] Assignee: International Business Machines Corporation, Armonk, N.Y.

[21] Appl. No.: 995,494

[22] Filed: Dec. 23, 1992

[51] Int. Cl.[5] ..... H01B 7/08

[52] U.S. Cl. ..... 174/117 FF; 174/72 TR; 174/885; 174/117 F; 333/238; 439/61; 439/65; 439/67; 439/74

[58] Field of Search ..... 174/117 F, 117 FF, 117 R, 174/885, 845, 72 TR; 439/59, 61, 65, 67, 74; 333/238, 243

[56] References Cited

U.S. PATENT DOCUMENTS

| | | | |
|---|---|---|---|
| 3,612,744 | 10/1971 | Thomas et al. | 174/36 |
| 3,728,661 | 4/1973 | Kassabgi | 174/117 FF |
| 3,772,776 | 11/1973 | Wwisenburger | 174/117 R |
| 4,060,889 | 12/1977 | Zielinski | 174/117 R |
| 4,116,516 | 9/1978 | Griffen | 439/67 |
| 4,157,612 | 6/1979 | Rainal | 174/117 F |
| 4,410,088 | 4/1984 | Anderson | 333/1 |
| 4,755,911 | 7/1988 | Suzuki | 361/414 |
| 4,913,662 | 4/1990 | Noy | 174/117 FF |
| 5,003,273 | 3/1991 | Oppenberg | 174/117 FF |

FOREIGN PATENT DOCUMENTS

| | | | |
|---|---|---|---|
| 297297 | 1/1989 | European Pat. Off. | 174/117 F |
| 2613406 | 10/1977 | Germany | 174/72 TR |

OTHER PUBLICATIONS

S. Argyrakis, "High Frequency/High Density/High Vacuum Transmission Line Interface" Connection Technology, Feb. 1991.

*Primary Examiner*—Morris H. Nimmo
*Attorney, Agent, or Firm*—Harold Huberfeld

[57] ABSTRACT

An electrical cable having a plurality of flat, flexible cable sections. Each section has flat, electrically conductive ground layers on at least the top and bottom surfaces thereof, and a plurality of flat, electrically conductive signal conductors between the ground layers. A plurality of dielectric layers separates the signal conductors from each other and from the ground layers. Each signal conductor includes an exposed surface extending a short distance from the end of the conductor along the length of each section. Adjacent cable sections are positioned relative to each other so that the exposed surfaces of corresponding signal conductors face each other. A plurality of connector assemblies is interposed between adjacent cable sections for electrically conducting the exposed surfaces of the corresponding signal conductors. Retaining means are provided for securing the ends of adjacent cable sections and connector assemblies in electrical contact with each other. The adjacent cable sections terminate at the retaining means and reverse direction to create an accordian type configuration for the cable.

4 Claims, 4 Drawing Sheets

ELECTRICAL CABLE HAVING FLAT, FLEXIBLE, MULTIPLE CONDUCTOR SECTIONS

The present invention relates generally to flat, flexible, multiple conductor electrical cables and more particularly to a sectional design for such flat, flexible, multiple conductor cables.

BACKGROUND OF THE INVENTION

Flat, flexible, multiple conductor, tuned-impedance electrical cables and transmission lines, such as those shown in U.S. Pat. No. 3,612,744 to Thomas and U.S. Pat. No. 4,441,088 to Anderson have been known and used for many years. Recently they have been proposed for use in testing microelectronic devices and circuits as a means for communicating high frequency, high density electrical signals along a tuned-impedance transmission line to such devices and circuits under test from test equipment located outside a test chamber. Such use is discussed in IBM Technical Disclosure Bulletin, Vol. 34, No. 2, July 1991 and in the publication entitled "High Frequency/High Density/High Vacuum Transmission Line Interface" by S. N. Argyrakis, one of the inventors in the present application, published Feb. 19, 1991 in CONNECTION TECHNOLOGY. For many such uses, Applicants have found that it is desirable to have large numbers of signal-carrying conductors in such cables, for example, approximately 900 conductors. Although it is possible to build cables of the type heretofore described with that number of conductors, Applicants have recognized that in certain applications, such cables may not have the degree of flexibility required. In particular, Applicants have recognized that in certain instances, it is desirable to route such cables along paths defined by existing service conduits. Applicants have recognized that a need exists for a flat, flexible, multiple conductor, tuned-impedance electrical cable having a large number of signal-carrying conductors which can meet the above requirements.

SUMMARY OF THE INVENTION

A feature of the present invention is the provision of a flat, tuned-impedance electrical cable which includes both a large number of signal-carrying conductors and a high degree of flexibility.

Another feature of the present invention is the provision of a flat, flexible, tuned-impedance, multiple conductor electrical cable which may be easily routed along the path of existing service conduits.

A further feature of the present invention is the provision of a flat, flexible, tuned-impedance, multiple conductor electrical cable which is both relatively simple and inexpensive to manufacture.

Thus, in accord with the present invention, an electrical cable is provided having a plurality of flat, flexible cable sections. Each section has flat, electrically conductive ground layers on at least the top and bottom surfaces thereof, and a plurality of flat, electrically conductive signal conductors between the ground layers. A plurality of dielectric layers separates the signal conductors from each other and from the ground layers. Each signal conductor includes an exposed surface extending a short distance from the end of the conductor along the length of each section. Adjacent cable sections are positioned relative to each other so that the exposed surfaces of corresponding signal conductors face each other. A plurality of connector assemblies is interposed between adjacent cable sections for electrically conducting the exposed surfaces of the corresponding signal conductors. Retaining means are provided for securing the ends of adjacent cable sections and connector assemblies in electrical contact with each other. The adjacent cable sections terminate at the retaining means and reverse direction to create an accordion type configuration for the cable.

Other features and advantages of the present invention will become apparent from the following detailed description of the invention when considered in conjunction with the accompanying drawings.

DESCRIPTION OF THE PREFERRED EMBODIMENTS

Figure 1:
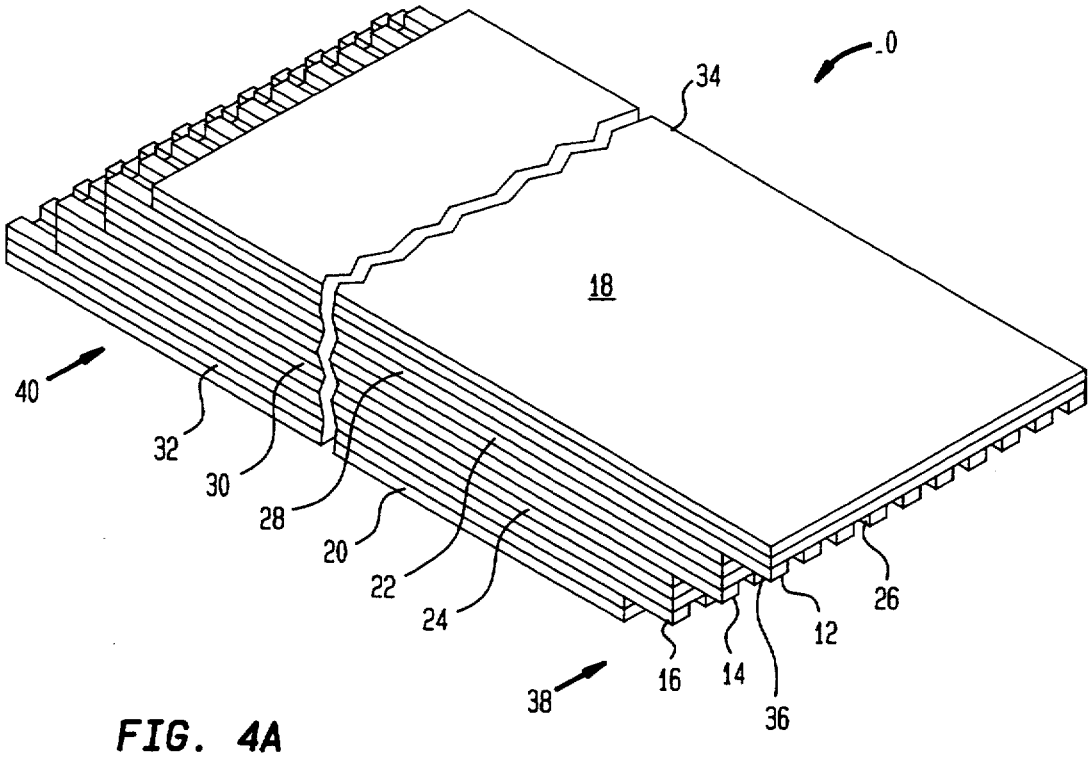
FIG. 1 shows a pictorial view of a first embodiment of a section of electrical cable of the present invention in schematic form.
Figure 2:
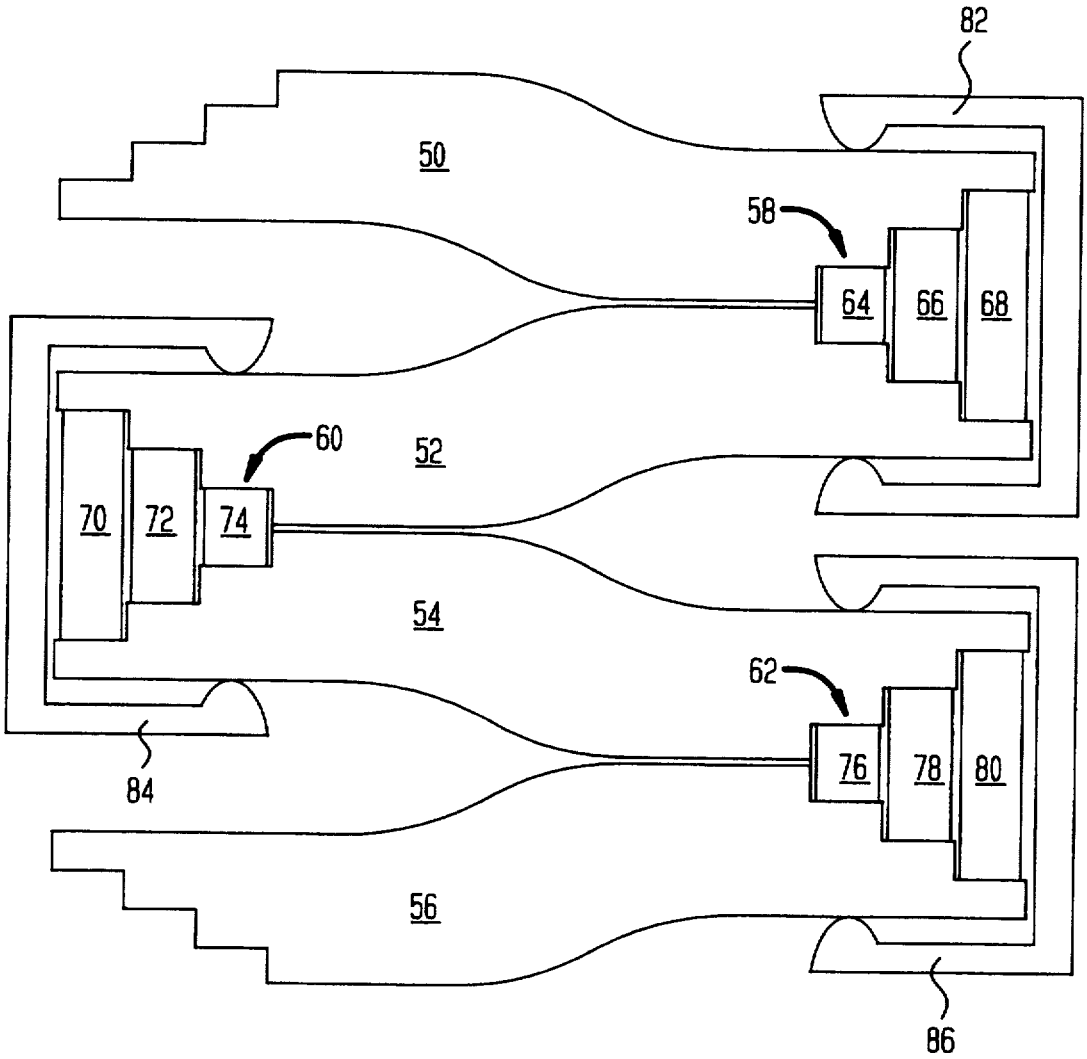
FIG. 2 shows a side view of a first embodiment of the electrical cables of the present invention in schematic form.
Figure 3A:
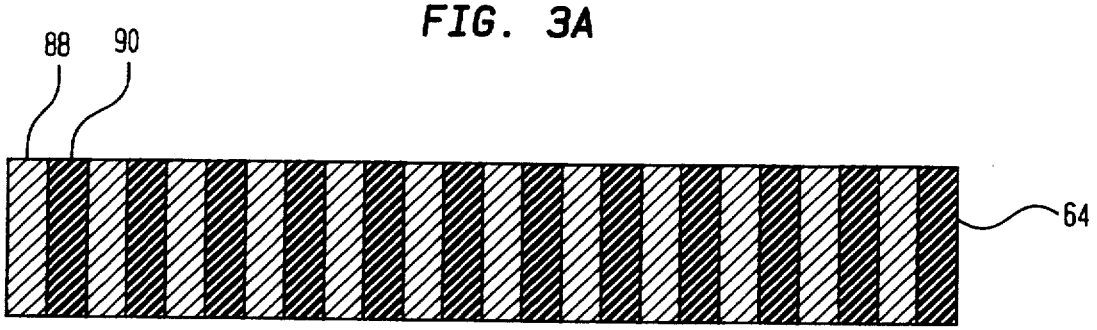
FIGS. 3A 3B and 3C show front views in schematic form of electrical connectors used with the electrical cable of the present invention.
Figure 3B:
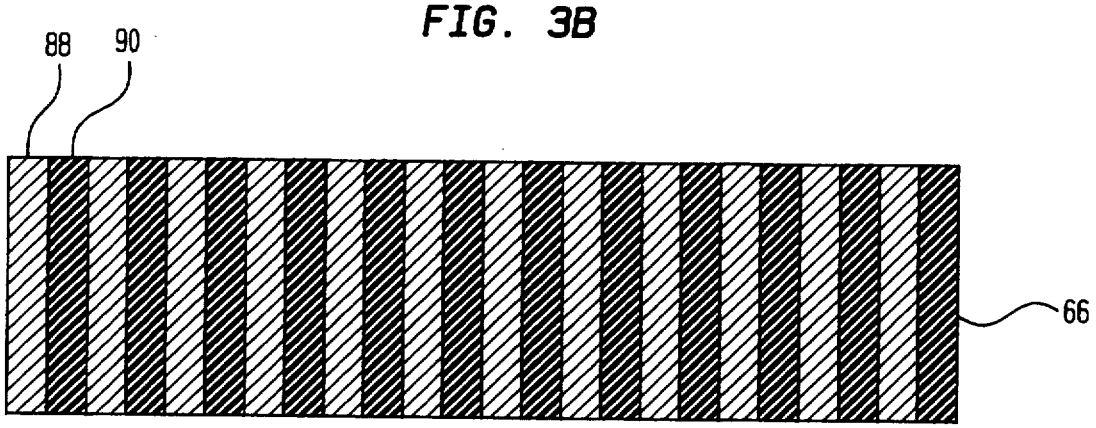
Figure 3C:
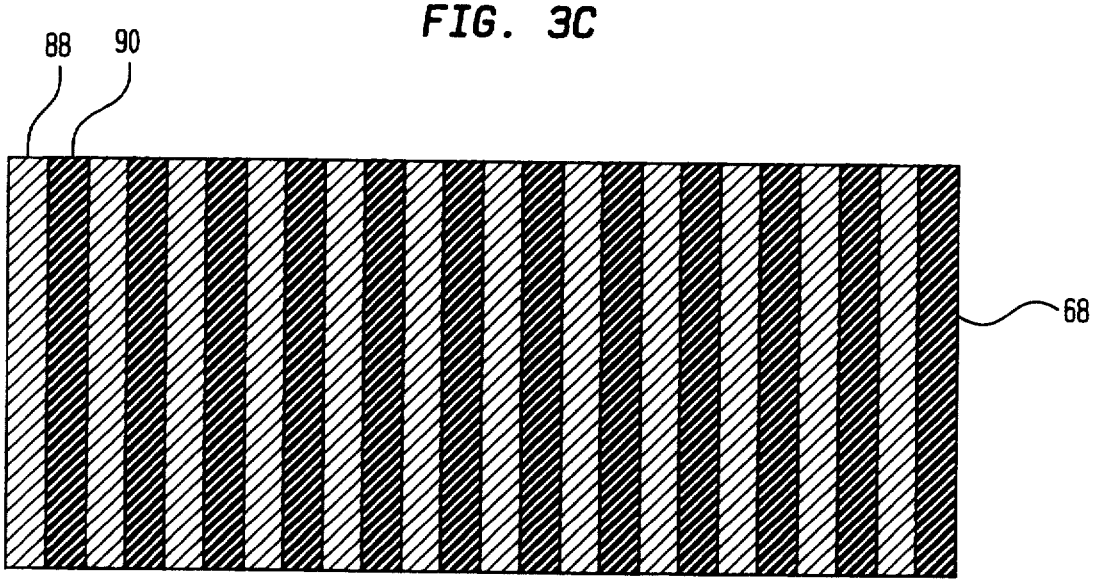

Referring to FIG. 1, a pictorial schematic, not to scale, of a section of cable 10 of the present invention is shown. The cable includes three layers 12, 14 and 16 of electrically conductive signal carrying conductors. For ease of illustration, a relatively few number of such conductors are shown. In a preferred embodiment, such a cable is approximately three inches wide and includes approximately 150 signal-carrying conductors per layer for a total of 450 signal conductors. Electrically conductive copper ground layers, 18 and 20, are located at the top and bottom of the cable section. In addition, copper ground layers, 22 and 24, are interposed between the layers 12 and 14 and 14 and 16, respectively, of signal-carrying conductors. Suitable dielectric layers, such as polyimide layers 26, 27, 28, 29, 30, and 32 separate the conductive ground layers from the flat electrically conductive signal conductors. The portion 34 of the cable 10 is of the stripline type in which the signal layers are sandwiched between a layer of dielectric material and shielded on top and bottom with copper foil forming suitable ground planes. The characteristic impedance of such stripline cables is defined in accord with the following formula:

$$Z_o = \frac{60}{\sqrt{e_r}} \operatorname{Ln}\left(\frac{4b}{0.67\pi W\left(0.8 + \frac{t}{W}\right)}\right) \quad (1)$$

where $Z_o$=characteristic impedance in ohms $e_r$=dielectric constant of the cable insulating material W=width of a signal carrying conductor t=thickness of a signal carrying conductor b=distance between ground plane layers The end portions of the section of cable 10 are stepped to include an exposed portion of each of the signal conductors, for example, the portion 36 of the conductors in layer 12, for a short distance from the end of each conductor along the length of each cable section. Thus, the ends 38 and 40 of cable section 10 are known as a micro-strip design in which a signal conductor is separated by a dielectric from a single ground plane. The characteristic impedance of such a cable portion is defined by the following formula:

$$Z_o = \frac{87}{\sqrt{e_r + 1.41}} \operatorname{Ln}\left(\frac{5.98h}{0.8W + t}\right) \quad (2)$$

where:

$Z_o$, $e_r$, W, and t are defined as in equation (1) and h=thickness of the dielectric layer FIG. 2 shows a plurality of cable sections 50, 52, 54 and 56 of the type shown as section 10 in FIG. 1 combine to form the electrical cable of the present invention. The illustrated thickness of the cable sections 50, 52, 54, and 56 is greatly exaggerated The cable sections 50, 52, 54, 56 may be in any desired length but typically are on the order of six inches in length. Adjacent cable sections 50 and 52, 52 and 54, and 56 and 56 are positioned relative to each other so that the exposed surfaces of corresponding signal conductors face each other as illustrated at ends 58, 60 and 62. Although for ease of illustration, only four cable sections have been shown, it should be understood that the cables of the present invention may include any desired number of sections sufficient to create a cable of desired length. Typically, the thickness of each cable section is on the order of 0.04 inches. A plurality of connector assemblies are interposed between adjacent cable sections for electrically connecting the exposed surfaces of the corresponding signal-carrying conductors. Thus, connector assembly 64, 66 and 68 are utilized at cable end 58; connectors 70, 72 and 74 are utilized at cable end 60; and connectors 76, 78 and 80 are utilized at cable end 62. The cable ends are secured by means of retaining clamps 82, 84 and 86 which secure the ends of adjacent cable sections and maintain the connector assemblies in good electrical contact with the exposed surfaces of the corresponding signal-carrying conductors. If desired, the connector assemblies may be additional pinned to their connecting cable section to avoid any creep between a connector and its associated cable sections. Thus, each cable section terminates at a respective clamp and reverses direction to create an accordion type configuration for the electrical cable. As shown in FIGS. 3A, 3B and 3C, the connectors 64, 66 and 68 include alternating electrically conductive layers 88 and electrically insulating layers 90 of elastomeric material with the electrically conductive layers 88 being in electrical contact with the signal-carrying conductors to which they are aligned. Connector assemblies of this type are of a known construction and may be of the general type manufactured and sold by Fujipoly, Inc. The impedance of such connecting elements may be tuned to the desired characteristic impedance by selection of the appropriate dielectric material in a known manner.

The retaining means 82, 84 and 86 may be of any known construction but are preferably made of conductive-spring metal having a C-shaped cross section. In this first embodiment of the present invention, the cable sections and accordingly the signal-carrying conductors therein, are linear when the cable is in an unflexed state. And in any event, remain aligned in a given plane.

Furthermore, the ends of each cable section are perpendicular to the linear signal-carrying conductors 12, 14 and 16.

Figure 4A:
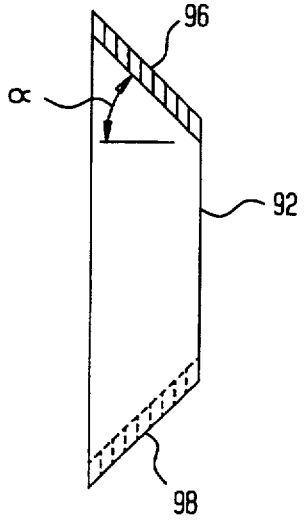
FIGS. 4A and 4B show a second embodiment of the electrical cable of the present invention in schematic form.
Figure 4B:
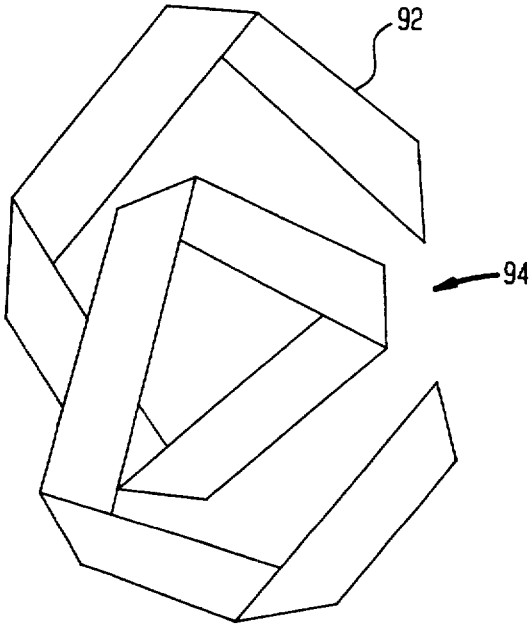
Figure 5:
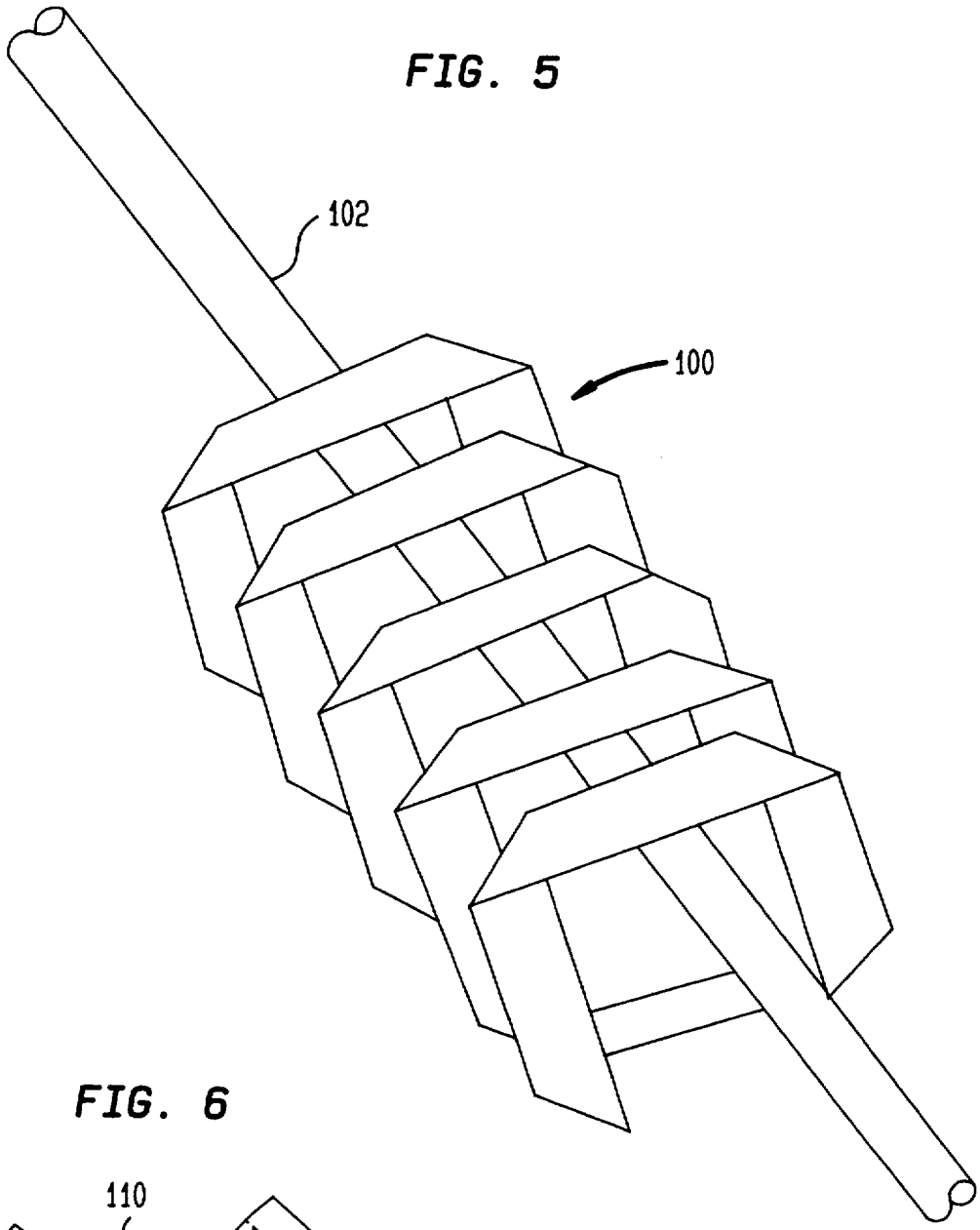
FIG. 5 shows a typical use of the cable shown in FIG. 4.

FIGS. 4A, 4B and 5 show a second embodiment of the electrical cable of the present invention wherein each section of 92 of a cable 94 includes ends 96 and 98, respectively, which are tapered with respect to the linear conductors included in this section 92. In the embodiment shown in the FIGS. 4A and 4B, the angle $\alpha$ of taper is 45 degrees. A cable of this type is able to wrap around a linear path as illustrated in FIG. 5 wherein the cable 100 wraps around a shaft 102.

Figure 6:
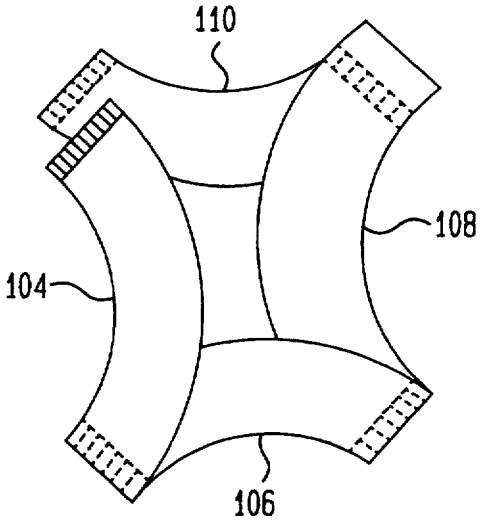
FIG. 6 shows a third embodiment of an electrical cable of the present invention in schematic form.

In a third embodiment of the present invention, a similar wrap around effect may be achieved wherein each of the cable sections 104, 106, 108 and 110, are arcuate in shape causing the signal-carrying conductors to travel through an arcuate path when the cable is in an unflexed state. Although each section may extend through any desired arc, as illustrated in FIG. 6, these sections extend through an arc of 90 degrees. The ends of adjacent cable sections in the embodiments shown in FIGS. 4B, 5, and 6 are clamped and connected in an identical manner with that shown in FIG. 2.

Thus, the present invention provides an electrical cable composed of flat, flexible sections, each carrying a large number of electrical signal-carrying conductors. Because of its unique, accordion type design, the electrical cable of the present invention is exceptionally flexible in spite of the large number of signal-carrying conductors contained therein. By either tapering the ends of the cables or curving sections of such cables, electrical cables of the present invention may be easily routed along a desired linear path. Furthermore, the construction of the cables of the present invention makes them both relatively simple and inexpensive to manufacture.

While there have been described what are at present considered to be the preferred embodiments of the present invention, it will be obvious to those skilled in the art that various changes and modifications may be made therein, without departing from the invention, and it is, therefore, aimed in the appended claims to cover all such changes and modifications as follow in the true spirit and scope of the present invention.

What is claimed is:

1. An electrical cable comprising:

a plurality of flat, flexible cable sections each section being adjacent at least one other section and having flat electrically conductive ground layers on at least the top and bottom surfaces of each section, a plurality of flat electrically conductive signal conductors between said ground layers, and a plurality of dielectric layers separating said signal conductors from each other and said ground layers; wherein each of said signal conductors extends along an arcuate path when said cable is in an unflexed state and includes an exposed surface extending a short distance from the end of each conductor along the length of each section; and wherein adjacent cable sections are positioned relative to each other so that said exposed surfaces of corresponding signal conductors on one cable section face those of the other cable section;

a plurality of connector assemblies, interposed between said adjacent cable sections for electrically connecting said exposed surfaces of said corresponding signal conductors; and retaining means for securing the ends of adjacent cable sections and connector assemblies in electrical contact with each other, said adjacent cable sections terminating at said retaining means and reversing direction to create an accordion type configuration for said cable.

2. The cable of claim 1 wherein each of said signal conduct extends through an arc of 90 degrees.

3. An electrical cable comprising:

a plurality of flat, flexible cable sections each section being adjacent at least one other section and having flat electrically conductive ground layers on at least the top and bottom surfaces of each section, a plurality of flat electrically conductive signal conductors between said ground layers, and a plurality of dielectric layers separating said signal conductors from each other and said ground layers; wherein each of said signal conductors is linear when said cable is in an unflexed state and includes an exposed surface extending a short distance from the end of each conductor along the length of each section; and wherein adjacent cable sections are positioned relative to each other so that said exposed surfaces of corresponding signal conductors on one cable section face each other these of the other cable section and the ends of each cable section are tapered at an angle less than 90 degrees with respect to said linear signal conductors;

a plurality of connector assemblies, interposed between said adjacent cable sections for electrically connecting said exposed surfaces of said corresponding signal conductors; and retaining means for securing the ends of adjacent cable sections and connector assemblies in electrical contact with each other, said adjacent cable sections terminating at said retaining means and reversing direction to create an accordion type configuration for said cable.

4. The cable of claim 3 wherein said angle is 45 degrees.

* * * * *